United States Patent [19]

Hamaguchi

[11] 4,174,902

[45] Nov. 20, 1979

[54] DETECTION OF DEVELOPER POWDER AMOUNT CONTAINED IN A DEVELOPER RESERVOIR

[75] Inventor: Hiroshi Hamaguchi, Sakai, Japan

[73] Assignee: Sharp Kabushiki Kaisha, Osaka, Japan

[21] Appl. No.: 844,204

[22] Filed: Oct. 21, 1977

[51] Int. Cl.[2] ..... G03G 15/00

[52] U.S. Cl. ..... 355/3 DD; 118/712; 222/DIG. 1

[58] Field of Search ..... 355/3 R, 3 DD, 14; 118/646; 222/DIG. 1

[56] References Cited

U.S. PATENT DOCUMENTS

| | | | |
|---|---|---|---|
| 3,520,445 | 7/1970 | Hansen | 222/DIG. 1 X |
| 3,572,551 | 3/1971 | Gillespie et al. | 118/646 X |
| 3,593,842 | 7/1971 | Berg | 118/646 X |
| 3,639,051 | 2/1972 | Charlap et al. | 355/3 DD |
| 3,951,309 | 4/1976 | Kadowaki | 222/DIG. 1 X |

FOREIGN PATENT DOCUMENTS

| | | | |
|---|---|---|---|
| 1120900 | 7/1968 | United Kingdom | 355/3 DD |

*Primary Examiner*—Fred L. Braun

*Attorney, Agent, or Firm*—Birch, Stewart, Kolasch & Birch

[57] ABSTRACT

An opening is formed in a bottom wall of a developer reservoir, where a U-shaped diaphragm is secured. The diaphragm is bent downward when developer powder is present in the developer reservoir more than a predetermined amount. When the quantity of developer powder decreases below the predetermined amount during a development operation, the diaphragm returns to its initial configuration, that is, the diaphragm is bent upward. The bent conditon of the U-shaped diaphragm is detected through the use of a suitable detection device such as a microswitch, whereby an alarm lamp is activated when the developer powder decreases to below the predetermined amount.

15 Claims, 7 Drawing Figures

DETECTION OF DEVELOPER POWDER AMOUNT CONTAINED IN A DEVELOPER RESERVOIR

BACKGROUND AND SUMMARY OF THE INVENTION

The present invention relates to a developer reservoir of an electro-photographic copying machine and, more particularly, to a detection means for detecting the amount of developer powder contained in the developer reservoir.

There are various kinds of systems for detecting the amount of developer powder contained in the developer reservoir of an electro-photographic copying machine.

A typical example of an optical detection system is described in Japanese Patent Laid Open No. 50-34243, wherein a light beam impinges on a developing roller. A reflected light beam from the developer roller surface is detected by an opto-electric converter, of which an output level indicates the amount of developer powder carried on the developing roller. In this system, an accurate detection can not be ensured since the light emitting element and the light receiving element are positioned within the developer reservoir and they may be smudged by the developer powder.

A typical example of a mechanical detection system is described in Japanese Utility Laid Open No. 50-50035, wherein a rotatable leaf is disposed within the developer reservoir. The inclination of the rotatable leaf indicates the amount of the developer powder contained in the developer reservoir. In this system, there is a possibility that the developer powder may preclude the preferred rotational operation of the rotatable leaf.

Other systems for detecting the amount of powder, for example, the electrostatic capacitance type and the torque variation detection type, are very complicated and, therefore, they are not suited for the electrophotographic copying machine wherein the consumption of a very little amount of powder should be detected.

Accordingly, an object of the present invention is to provide a detection means for detecting an amount of developer powder contained in a developer reservoir of an electrophotographic copying machine.

Another object of the present invention is to provide a developer powder detection device having a simple construction.

Still another object of the present invention is to provide a powder detection device which can detect the consumption of a small amount of powder.

Yet another object of the present invention is to provide an alarm system which activates an indication lamp when the developer powder contained in the developer reservoir becomes less than a predetermined amount.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an opening is formed in a bottom wall of a developer reservoir, where a U-shaped diaphragm is secured. The diaphragm is bent downward when developer powder is present in the developer reservoir in more than a predetermined amount. When the quantity of developer powder decreases to below the predetermined amount during the development operation, the diaphagm returns to its initial shape, that is, the diaphagm is bent upward. The bent condition of the U-shaped diaphagm is detected through the use of a suitable detection means such as a microswitch, whereby an alarm lamp is activated when the developer powder decreases to below the predetermined amount.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
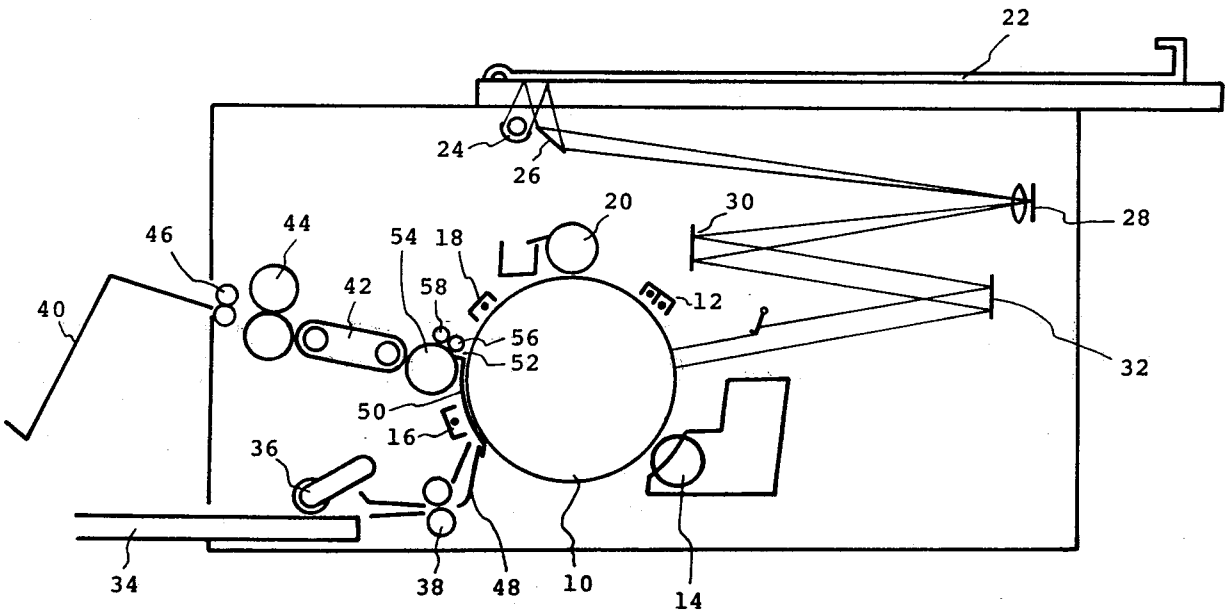
FIG. 1 is a sectional view of an electrophotographic copying machine employing an embodiment of a developer reservoir of the present invention.

Referring now in detail to the drawings, and to facilitate a more complete understanding of the present invention, an electrophotographic copying machine employing an embodiment of a developer reservoir of the present invention will be first described with reference to FIG. 1. FIG. 1 shows the electrophotographic copying machine having a travelling original carrier. However, the present invention is applicable to an electrophotographic copying machine having a scanning optical exposure system.

A drum 10 is coated with a photosensitive material and is associated with a drive mechanism so that the drum 10 rotates at a constant speed in the clockwise direction, as viewed in FIG. 1. A corona charging device 12 for uniformly charging the photosensitive material, a developing roller 14, another corona charging device 16 for transcription purposes, an AC corona charging device 18 for renewing the photosensitive material, and a cleaner unit 20 are mounted at stations adjacent the periphery of the drum 10.

An original carrier 22 is driven to travel in a reciprocating fashion so that an electrostatic latent image is formed on a uniformly charged drum surface by virtue of a stationary optical exposure system comprising a lamp 24, a first mirror 26, a mirror lens unit 28, a second mirror 30 and a third mirror 32.

A copy paper is fed from a stack 34 to the transcription section by paper feeding rollers 36 and 38 in synchronization with the drum revolution. The synchronization method is well known in the art and the synchronization is accomplished, for example, by detecting the revolution of the drum carrying the developed image formed thereon. The copy paper passing the transcription section and carrying the transcribed image thereon is fed to a tray 40 through a fixing section 42 with the use of paper feed rollers 44 and 46.

A pair of guide plates 48 are provided for guiding the copy paper toward the drum surface. A stationary copy paper separation guide plate 50 is installed along the drum surface with a thin gap provided therebetween at the transcription section. The stationary copy paper separation guide plate 50 has a standing end 52. Roller means 54, 56 and 58, are positioned near the standing end 52 in order to catch the leading edge of the copy paper separated from the drum surface by the standing end 52.

Figure 2:
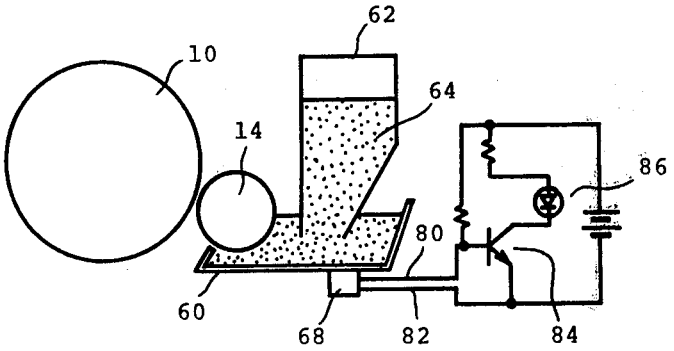
FIG. 2 is a schematic view of the developer reservoir and an alarm indication system of the present invention.

FIG. 2 shows the developing section and an alarm indication system of the present invention. Like elements corresponding to those of FIG. 1 are indicated by like numerals.

The developing section comprises mainly the developing roller 14, a developer powder reservoir 60, and a cartridge 62 for supplying developer powder 64 to the developer powder reservoir 60. The developing roller 14 is a magnetic roller for developing an electrostatic latent image formed on the drum 10 through the use of a magnet brush.

An opening 66 is formed in the bottom wall of the developer reservoir 60 to which a device 68, for detecting the quantity of developer powder, is secured.

Figure 3:
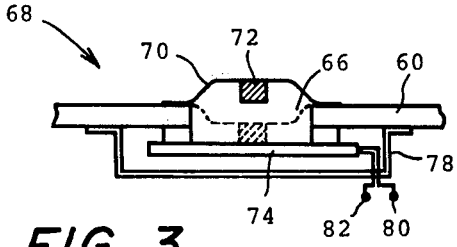
FIG. 3 is a sectional view of an embodiment of a developer powder detection device of the present invention.
Figure 4:
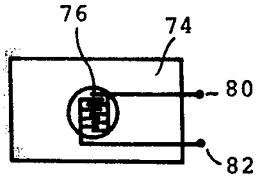
FIG. 4 is a plan view of a switch contact pattern employed within the developer powder detection device of FIG. 3.

FIG. 3 shows an embodiment of the developer powder detection device 68 of the present invention. A U-shaped section diaphragm 70 is secured to the bottom wall of the developer reservoir 60 in such a manner to cover the opening 66. The diaphragm 70 is shaped so that it bulges upward in the normal condition, or, when any force is not applied to the diaphragm 70.

A conductive rubber chip 72 is fixed to the bottom surface of the diaphragm 70. A printed circuit board 74 carrying switch contact patterns 76 is disposed below the diaphragm 70 in such a manner that the switch contact patterns 76 are located at the position corresponding to the conductive rubber chip 72. A protection cover 78 is secured to the bottom wall of the developer reservoir 60 in order to protect the detection elements from the ambience.

The diaphragm 70 is made of, for example, silicon rubber, a biphenyl chloride film or a polyurethane film. When the developer powder 64 is contained in the developer reservoir 60 more than a predetermined amount, the diaphragm 70 bulges downward due to the powder weight as shown by broken lines in FIG. 3.

When the diaphragm 70 is depressed downward, the conductive rubber chip 72 contacts the switch contact patterns 76 formed on the printed circuit board 74. At this moment, terminals 80 and 82 are electrically connected to each other, whereby a transistor 84 is placed in the OFF state and, therefore, an alarm lamp 86 is not activated.

When the developer powder 64 contained in the developer powder reservoir 60 decreases to below a predetermined amount during the development operation, the diaphragm 70 bulges upward and, therefore, the terminals 80 and 82 are opened. The transistor 84 is thus turned ON, thereby activiting the alarm lamp 86. The operator is therefore required to add the developer powder 64 when the alarm lamp 86 is activated.

Figure 5:
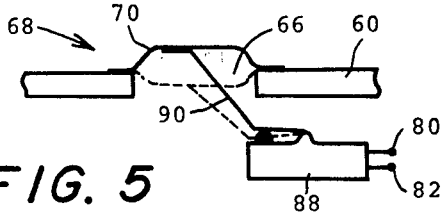
FIG. 5 is a sectional view of another embodiment of a developer powder detection device of the present invention.

FIG. 5 shows another embodiment of the developer powder detection device 68 of the present invention. Like elements corresponding to those of FIG. 3 are indicated by like numerals.

A micro-switch 88 is disposed below the bottom wall of the developer reservoir 60. An actuating lever 90 is fixed to the diaphragm 70 so as to close the micro-switch 88 when the diaphragm 70 is depressed downward by virtue of the developer powder weight. In this example, the diaphragm 70 can be flat shaped, because the spring force of the actuating lever 90 forces the diaphragm 70 to bulge upward when the developer powder amount decreases to below the predetermined value.

The operation boundary of the diaphragm 70, or, the detection boundary of the developer powder amount can be adjusted by selectively determining the lever ratio of the actuating lever 90. In a preferred form, when the developer powder mounted on the diaphragm 70 falls below ten (10) grams, the diaphragm 70 is depressed upward to open the micro-switch 88. A typical size of the bottom wall of the developer reservoir 60 is 20 cm $\times$3 cm, and a typical size of the diaphragm 70 is 20 mm$\phi$.

Figure 6:
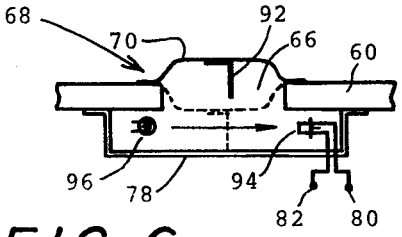
FIG. 6 is a sectional view of still another embodiment of a developer powder detection device of the present invention.

FIG. 6 shows still another embodiment of the developer powder detection device 68 for detecting the quantity of developer powder which has been used. Like elements corresponding to those of FIGS. 3 and 5 are indicated by like numerals.

A shielding plate 92 is fixed to the bottom surface of the diaphragm 70. When a light receiving element 94 receives a light beam emitted from a light emitting element 96, the transistor 84 is turned ON to activate the alarm lamp 86. On the contrary, when the developer powder 64 is present in the developer reservoir 60 in more than a predetermined amount, the diaphragm 70 is depressed downward. The light beam emitted from the light emitting element 96 is shielded by the shielding plate 92 and, therefore, the alarm lamp 86 is not activated.

Figure 7:
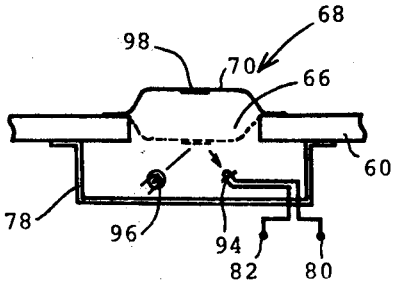
FIG. 7 is a sectional view of yet another embodiment of a developer powder detection devide of the present invention.

FIG. 7 shows yet another embodiment of the developer detection device 68 of the present invention. Like elements corresponding to those of FIGS. 3, 5 and 6 are indicated by like numerals.

A reflection plate 98 is fixed to the bottom surface of the diaphragm 70. When the light receiving element 94 receives the light beam emitted from the light emitting element 96 and reflected at the reflection plate 98, the transistor 84 is turned OFF to extinguish the alarm lamp 86. On the contrary, when the light amount directed to the light receiving element 94 decreases by the placement of the diaphragm 70 in the condition shown by the solid line in FIG. 7, the alarm lamp 86 is activated.

In the embodiments of FIGS. 6 and 7, there is no possibility that the light emitting element 96 and the light receiving element 94 are soiled by the developer powder 64 because they are surrounded by the diaphragm 70 and the protective cover 78.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In an electrophotographic copying machine wherein an image from a subject sheet is developed at a developing section through the use of developer powder contained in a developer reservoir, and the quantity of the developer powder contained in the developer reservoir is monitored and detected by a developer powder detection system, said developer powder detection system comprising:

a wall portion forming part of said developer reservoir, said wall portion having an opening formed therein;

a flexible film fixed to said wall so as to cover said opening formed in said wall, said flexible film being adapted to change its configuration based upon the quantity of the developer powder contained in said developer reservoir and a detection means for detecting the changes in the configuration of said flexible film.

2. The developer powder detection system of claim 1, wherein the opening is formed in the bottom wall of the developer reservoir, and said flexible film is fixed to said bottom wall of said developer reservoir so as to cover said opening, so that the flexible film extends in the downward direction when the developer powder is present in said developer reservoir in more than a predetermined amount.

3. The developer powder detection system of claim 2, wherein said detection means comprises:

a micro-switch disposed below said bottom wall of said developer reservoir; and an actuating lever is fixed to said flexible film and operatively associated with said micro-switch for operating said micro-switch in response to the location of said flexible film.

4. The developer powder detection system of claim 3, wherein said micro-switch is closed by said actuating lever when said flexible film bulges downward by virture of the weight of the developer powder contained in said developer reservoir.

5. The developer powder detection system of claim 4, which further comprises an alarm lamp; and a driving means for actuating said alarm lamp when said micro-switch is not closed.

6. The developer powder detection system of claim 3, wherein said actuating lever depresses said flexible film in an upward direction.

7. The developer powder detection system of claim 2, wherein said detection means is surrounded by a protection cover.

8. The developer powder detection system of claim 2, wherein said flexible film is a diaphragm.

9. The developer powder detection system of claim 8, wherein said diaphragm is shaped so as to bulge upward when the developer powder contained in said developer reservoir is less than said predetermined amount.

10. The developer powder detection system of claim 2, wherein said downward extension of the flexible film deactivates the detection system and the consumption of a predetermined amount of developer powder restores the flexible film from its extended position, thereby activating the detection system.

11. A developer powder detection system for detecting the consumption of developer powder used in an electrophotographic copying machine which comprises a developer reservoir having an opening formed in a wall portion thereof, a flexible film fixed to cover said opening, said flexible film being adapted to change its configuration based on the quantity of developer powder contained in the developer reservoir, and a detection means for detecting the change in configuration of the flexible film.

12. The developer powder detection system of claim 11, wherein the detection means includes a conductive member attached to the flexible film and a switch contact means disposed adjacent the conductive member, wherein when the developer powder is present in the developer reservoir in a predetermined amount, the conductive member is held in contact with the switch contact, and when the developer powder is consumed beyond a predetermined amount, the conductive member loses contact with the switch contact, thereby signaling the consumption of the developer powder.

13. The developer powder detection system of claim 11, wherein the detection means includes a micro-switch disposed adjacent the flexible film and an actuating lever fixed to said flexible film and operatively associated with said micro-switch for operating said micro-switch in response to the location of said flexible film.

14. The developer powder detection system of claim 11, wherein the detection means includes a shielding member attached to the flexible film and a light emitting element and a light receiving element disposed adjacent said shielding member, wherein when the developer powder is present in the developer reservoir in a predetermined amount, the shielding member interrupts the light beam between the light emitting element and the light receiving element, and when the developer powder is consumed beyond a predetermined amount the shielding member withdraws from interrupting said light beam, thereby signaling the consumption of the developer powder.

15. The developer powder detection system of claim 11, wherein the detection means includes a reflection plate attached to the flexible film and a light emitting element and a light receiving element disposed adjacent said reflection plate, wherein when the developer powder is present in the developer reservoir in a predetermined amount, the light receiving element receives the light beam emitted from the light emitting element as reflected by the reflection plate, and when the developer powder is consumed beyond a predetermined amount, the amount of light directed to the light receiving element is decreased, thereby signaling the consumption of the developer powder.

* * * * *